US005464030A

United States Patent [19]

Avellanet

[11] Patent Number: 5,464,030

[45] Date of Patent: Nov. 7, 1995

[54] TWIST HAIRDO ROLLER

[76] Inventor: Marisol Avellanet, 419 E. 93rd St.; Apt. 14D, New York, N.Y. 10128

[21] Appl. No.: 218,250

[22] Filed: Mar. 28, 1994

[51] Int. Cl.[6] ..... A45D 2/02

[52] U.S. Cl. ..... 132/245; 132/121; 132/212

[58] Field of Search ..... 132/122, 245, 132/246, 253, 264, 268, 212

[56] References Cited

U.S. PATENT DOCUMENTS

| | | | |
|---|---|---|---|
| 2,146,674 | 2/1939 | Huppert | 132/246 |
| 2,525,981 | 10/1950 | Webster | 132/246 |
| 2,579,204 | 12/1951 | Renstrom | 132/122 |
| 2,757,676 | 8/1956 | Hamilton | 132/253 |
| 4,031,907 | 6/1977 | Rogers | 132/122 |
| 4,361,159 | 11/1982 | Stefaniak | 132/41 R |
| 4,540,006 | 9/1985 | Collis | 132/246 |
| 4,630,622 | 12/1986 | Foreman | 132/253 |

*Primary Examiner*—John G. Weiss
*Attorney, Agent, or Firm*—Michael I. Kroll

[57] ABSTRACT

A twist hairdo roller is provided, which consists of a structure for wrapping the hair on a head of a woman into a twist hairdo. Components are for retaining the hair in the twist hairdo by frictionally engaging the hair against the wrapping structure.

4 Claims, 2 Drawing Sheets

TWIST HAIRDO ROLLER

BACKGROUND OF THE INVENTION

1. Field of the Invention

The instant invention relates generally to hairstyling implements and more specifically it relates to a twist hairdo roller.

2. Description of the Prior Art

Numerous hairstyling implements have been provided in prior art. For example U.S. Pat. Nos. 2,695,620 to Renstrom; 2,809,645 to Frakes et al. and 4,334,447 to Morrow all are illustrative of such prior art. While these units may be suitable for the particular purpose to which they address, they would not be as suitable for the purposes of the present invention as heretofore described.

Renstrom, Carl W.

CURLER

U.S. Pat. No. 2,695,620

An integrally molded unitary hair curler comprising a mandrel bifurcated to form a pair of leg portions. A structure for holding hair in place is in the mandrel. The leg portions have spaced opposed flat inner walls and curved outer walls, so as to form a hollow tubular construction which is closed at one end and open at the opposite end. The leg portions have ventilating holes in their inner and outer walls communicating with the open ends, so that air may freely enter the mandrel and circulate through the holes and through the open ends. The leg portions are integrally joined together by a transverse web intermediate the legs and adjacent the open end portion. The leg portions may pivot outwardly about the web when hair is placed between the leg portions.

Frakes, Helon F.

Shaw, Arthur K.

COMBINED HAIR CURLING AND WAVING ASSEMBLY

U.S. Pat. No. 2,809,645

A combined hair curling and waving assembly comprising an elongated curling rod for receiving thereabout a convoluted end portion of a strand of hair to be treaded. A tubular elongated waving sleeve includes mating shell members justaposable in circumposed relationship about the curling rod. The sleeve members include mating elongated notches in one edge thereof providing an elongated slot through one side of the sleeve for having an intermediate portion of the strand of hair extending therethrough. An intermediate portion of the sleeve member receiving thereabout an intermediate convoluted portion of the strand of hair being treated. A flexible retaining strap is operatively engaged with opposite ends of the tubular sleeve retaining the shell members in juxtaposition and circumposed relation about the curling rod. An intermediate portion of the strap extending longitudinally of the outer surface of the waving sleeve is for transverse engagement with an intermediate portion of the strand of hair being treated retaining the same in its convoluted relationship on the curling rod and waving sleeve.

Morrow, Willie L.

DOUBLE TWIST HAIR ROLLER

U.S. Pat. No. 4,344,447

A hair roller is provided having a generally cylindrical body portion with two end caps, which stretch a band of rubber or like resilient material across the surface of the body. The two end caps are rotatable in opposite directions to cause the band to stretch across the body in increasingly tight fashion without substantially displacing the central portions of the elastic, so that the hair thereon is not substantially disturbed.

SUMMARY OF THE INVENTION

A primary object of the present invention is to provide a twist hairdo roller that will overcome the shortcomings of the prior art devices.

Another object is to provide a twist hairdo roller that includes an elongated body with a pair of small combs secured at each opposite end, so that the hair on a head of a woman can be wrapped and retained thereto to form the twist hairdo.

An additional object is to provide a twist hairdo roller that is fabricated out of durable lightweight and pliable materials, so that when utilized will be comfortable to wear in the hair on the head of a woman.

A further object is to provide a twist hairdo roller that is simple and easy to use.

A still further object is to provide a twist hairdo roller that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
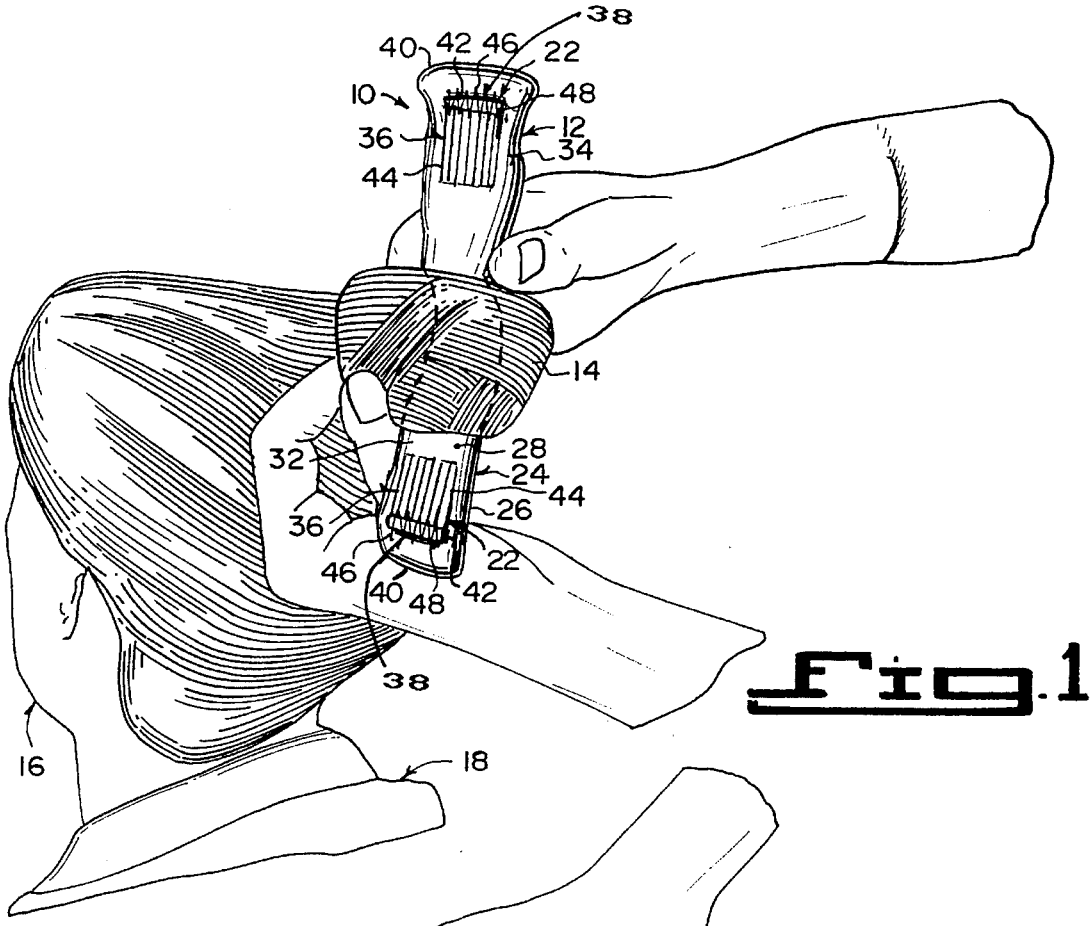
FIG. 1 is a perspective view showing the instant invention in a first step in making a twist hairdo on a head of a woman.
Figure 2:
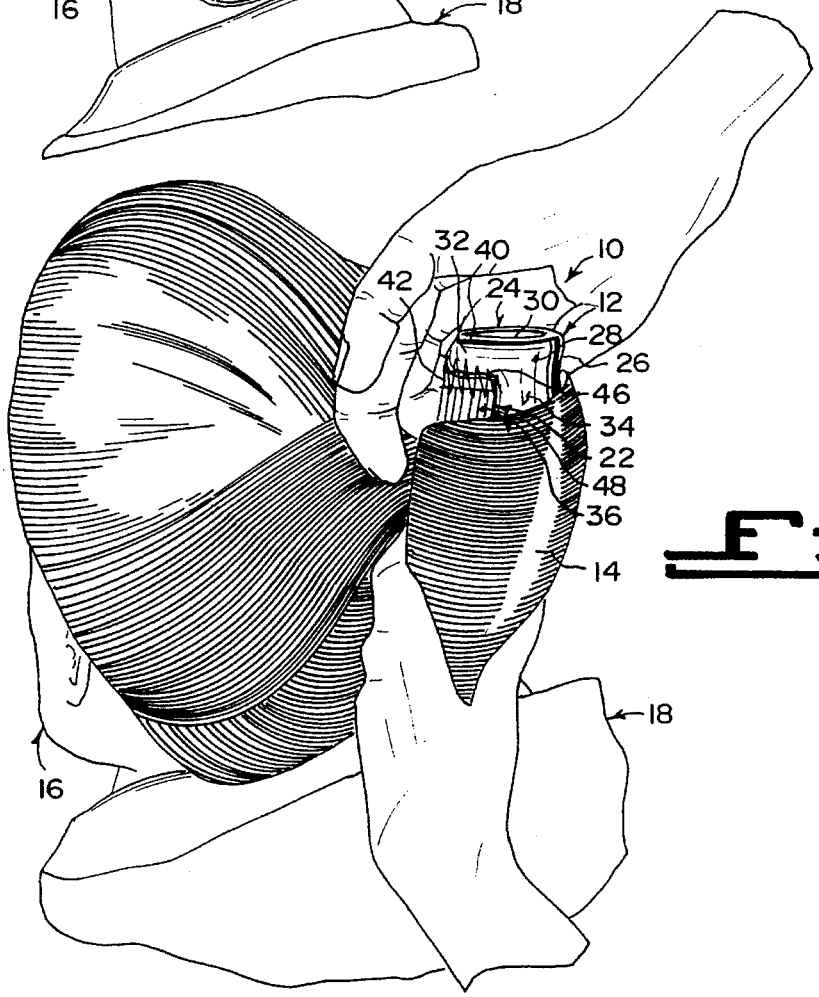
FIG. 2 is a perspective view of a second step in making the twist hairdo.
Figure 3:
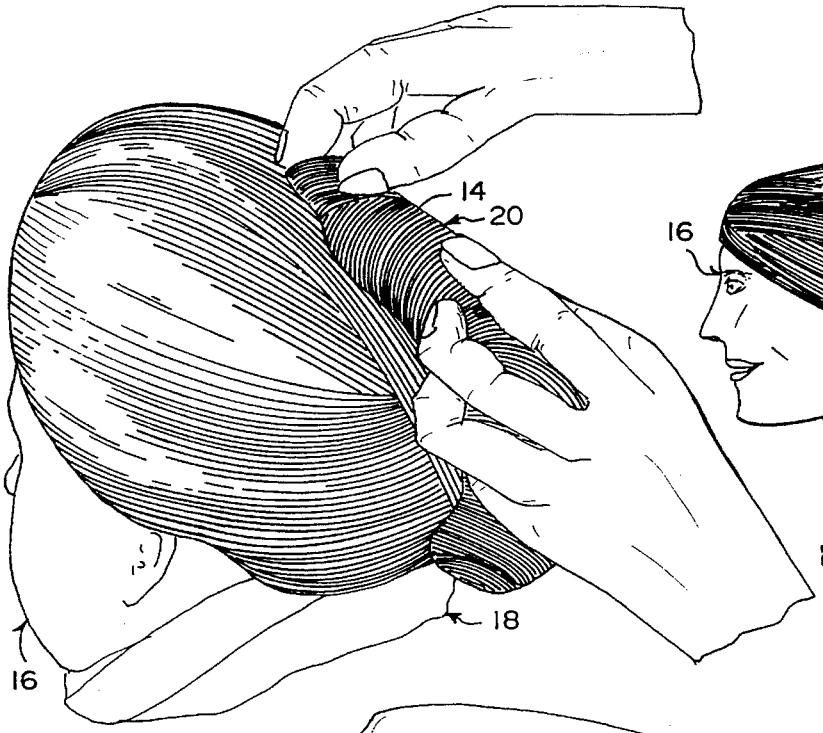
FIG. 3 is a perspective view of a third step in making the twist hairdo.
Figure 5:
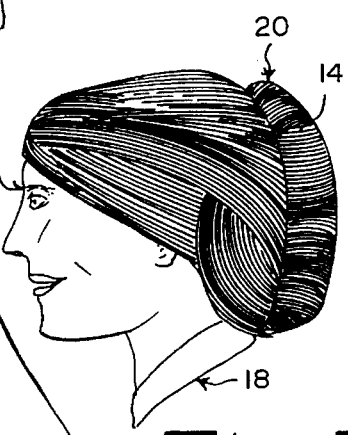
FIG. 5 is a side view of the head of the woman with the twist hairdo completed.
Figure 4:
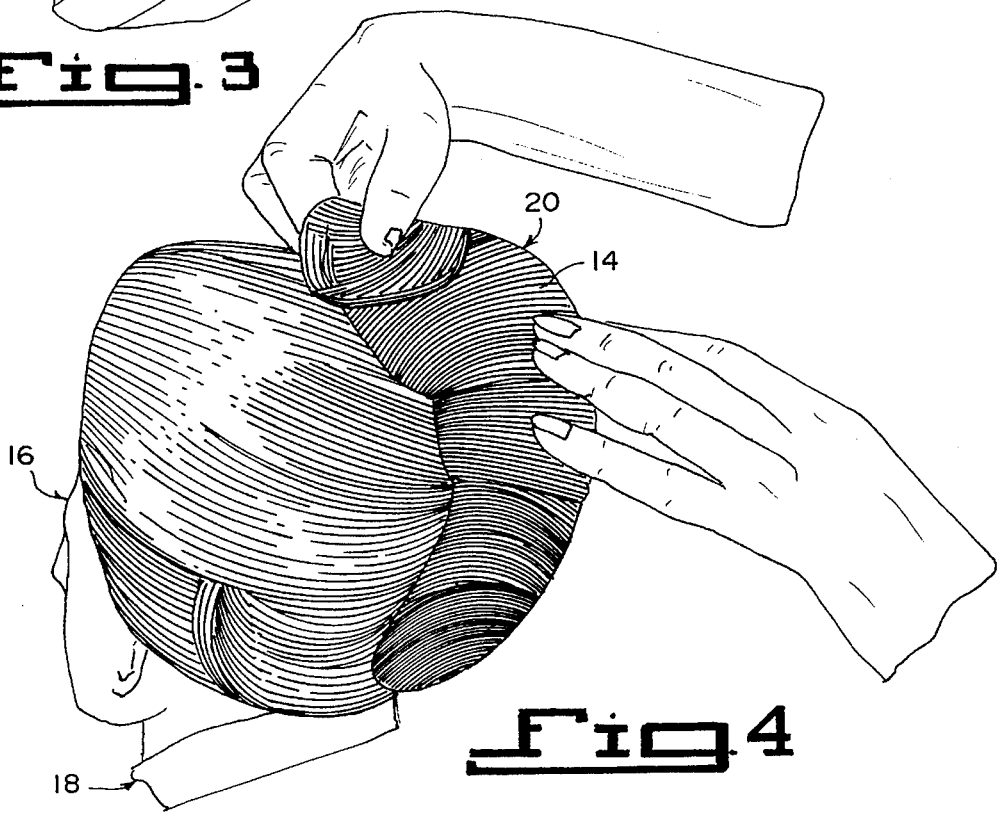
FIG. 4 is a perspective view of a fourth step in making the twist hairdo.

Turning now descriptively to the drawings, in which similar reference characters denote similar elements throughout the several views, FIGS. 1 and 2 illustrate a twist hairdo roller 10, which consists of a structure 12 for wrapping the hair 14 on a head 16 of a woman 18 into a twist hairdo 20, as shown in FIGS. 3 to 5. Components 22 are for retaining the hair 14 in the twist hairdo 20, by frictionally engaging the hair 14 against the wrapping structure 12.

The wrapping structure 12 is an elongated body 24. The elongated body 24 is a generally cylindrical barrel 26. The barrel 26 is fabricated out of pliable material 28, so that it can bend to conform to the shape of the head 16 of the woman 18.

The pliable material 28 includes a rubber core tube 30 and a lightweight foam rubber sleeve 32, which fits over the rubber core tube 30. The foam rubber sleeve 32 of the barrel 26 contains an undulating surface 34, to better engage with the hair 14 when the hair is being wrapped thereabout.

The retaining components 22 include a pair of small combs 36. Fasteners 38 are for securing each comb 36 to an opposite end 40 of the foam rubber sleeve 32, to hold the hair 14 in place. Each comb 36 consists of a spine 42 transversely positioned to the end 40 of the foam rubber sleeve 32. A plurality of teeth 44 extend from the spine 42 parallel to the longitudinal axis of the barrel 26, whereby the hair 14 will be held between the teeth 44 and the foam rubber sleeve 32.

The securing fasteners 38 is thread stitching 46 between the spine 42 and the end 40 of the foam rubber sleeve 32. Each comb 36 is fabricated out of a durable plastic material 48.

As seen in the drawings, FIGS. 1–4 in sequence, the hair is bunched up and wrapped around roller 10 which is then rotated to wind up the hair, until roller 10 is completely covered with hair and roller 10 is positioned where desired. Hair engaging combs 36 will hold roller 10 in place by intermeshing the hair with the teeth of the combs.

LIST OF REFERENCE NUMBERS

10 twist hairdo roller
12 wrapping structure
14 hair
16 head
18 woman
20 twist hairdo
22 retaining component
24 elongated body for 12
26 generally cylindrical barrel for 24
28 pliable material
30 rubber core tube
32 lightweight foam rubber sleeve
34 undulating surface on 32
36 small comb
38 fastener
40 end of 32
42 spine of 36
44 teeth of 36
46 thread stitching
48 durable plastic material for 36

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A twist hairdo roller which comprises:

a) means for wrapping the hair on a head of a woman into a twist hairdo, said wrapping means comprising an elongated body in the shape of a generally cylindrical barrel, said barrel being fabricated out of pliable material, so that it can bend to conform to the shape of the head of the woman, said pliable material including a rubber core tube and a lightweight foam rubber sleeve which fits over said rubber core tube and which forms an undulating surface to better engage with the hair when the hair is being wrapped thereabout; and b) means for retaining the hair in the twist hairdo by frictionally engaging the hair against said wrapping means, said retaining means comprising a pair of small combs fixing each of said combs to an opposite end of said foam rubber sleeve with the teeth of said combs extending toward each other to hold the hair in place.

2. A twist hairdo roller as recited in claim 1, wherein each said comb includes:

a) a spine transversely positioned to the end of said foam rubber sleeve; and b) a plurality of teeth extending from said spine parallel to the longitudinal axis of said barrel, whereby the hair will be held between said teeth and said foam rubber sleeve.

3. A twist hairdo roller as recited in claim 2, wherein thread stitching between said spine and the end of said foam rubber sleeve secured the comb to the sleeve.

4. A twist hairdo roller as recited in claim 3, wherein each said comb is fabricated out of a durable plastic material.

* * * * *